United States Patent [19]

Burrows

[11] Patent Number: 4,923,087

[45] Date of Patent: May 8, 1990

[54] TRASH STORAGE AND DISPOSAL COMBINATION UNIT

[75] Inventor: Roger A. Burrows, Huntington, W. Va.

[73] Assignee: RRRR Products, Inc., Huntington, W. Va.

[21] Appl. No.: 349,002

[22] Filed: May 9, 1989

[51] Int. Cl.[5] ..... B65D 25/16

[52] U.S. Cl. ..... 220/404; 220/1 T

[58] Field of Search ..... 220/404, 1 T

[56] References Cited

U.S. PATENT DOCUMENTS

| | | | |
|---|---|---|---|
| 3,784,049 | 1/1974 | Hawk | 220/63 |
| 4,027,774 | 6/1977 | Cote | 220/63 R |
| 4,418,835 | 12/1983 | Watts | 220/404 |
| 4,535,911 | 8/1985 | Goulter | 220/404 |
| 4,576,310 | 3/1986 | Isgar et al. | 220/404 |
| 4,589,570 | 5/1986 | Auten | 220/404 |
| 4,664,347 | 5/1987 | Brown et al. | 248/97 |
| 4,735,340 | 4/1988 | Preston | 220/404 |
| 4,763,808 | 8/1988 | Guhl et al. | 220/404 |

*Primary Examiner*—Steven M. Pollard

*Attorney, Agent, or Firm*—John L. Gray

[57] ABSTRACT

A combination trash container and disposal unit comprising a trash container and a trash bag held in said trash container in such a manner that the trash bag covers the upper opening of the trash container with the trash container so constructed that it may be nested and provide a space between the bases of adjacent trash containers so that hooks which may be placed on the sides of the trash container to hold the handles associated with the trash bags may be stored therein.

1 Claim, 2 Drawing Sheets

TRASH STORAGE AND DISPOSAL COMBINATION UNIT

BACKGROUND OF THE INVENTION

Trash containers containing flexible trash bags with means to hold the trash bag in the container have been available for sometime. Examples of these are U.S. Pat. No. 4,576,310, Isgar, et al., and U.S. Pat. No. 4,027,774, Cote. Other approaches have been those shown in U.S. Pat. No. 4,418,835, Watts, U.S. Pat. No. 4,535,911, Goulter, and U.S. Pat. No. 4,664,347, Brown, et al., as well as U.S. Pat. No. 4,735,340, Preston.

None of these approaches, however, have provided a combination trash container and trash bag with means to hold the trash bag in position so that it completely covers the upper top of the trash container so as to maintain the trash container in a clean condition after the trash bag has been removed.

In addition, in the manufacture, shipping, and inventorying of trash containers, because of their obvious bulk and size, it is necessary to nest them and if they are provided with means on the exterior thereof to hold a trash bag in position, this prevents appropriate nesting. There is no teaching of stacking the containers with space between each container to store the means for holding the trash bags in position so that they can be sold as add-on units by the purchaser.

SUMMARY OF THE INVENTION

This invention comprises a trash container in combination with a flexible trash bag of a size and shape adapted to fill said container and completely cover and overlap the upper open end of the container with the trash bag being provided with handles which will engage hooks on the exterior of the container. The container may be round, oval, rectangular, or any other desired shape. The container is provided with a collar around the open upper end of a size and shape so that when two containers are stacked, one within the other, there will be a space between adjacent base members of the containers sufficient to store the hooks which are to be placed on the exterior of the container by the purchaser.

Also, as part of this invention are novel means for attaching the hooks on the exterior of the trash container to hold the trash bags in position.

It is therefore an object of this invention to provide a combination trash storage and disposal unit wherein the trash bag portion of said unit will completely cover and protect the upper portion and the interior of the trash container and be held in place by exterior means.

It is also an object of this invention to provide such a combination trash storage and disposal unit wherein the trash containers may be stacked, one within the other, with sufficient space provided between the bases of adjacent trash containers so that the means adapted releasably to hold the trash bag in position may be stored therein.

It is a further object of this invention to provide a novel means of securing the means to hold the trash bag in place on the trash container.

These, together with other objects and advantages of the invention will become more readily apparent to those skilled in the art when the following general statements and descriptions are read in the light of the appended drawings.

DETAILED DESCRIPTION OF THE INVENTION

Figure 1:
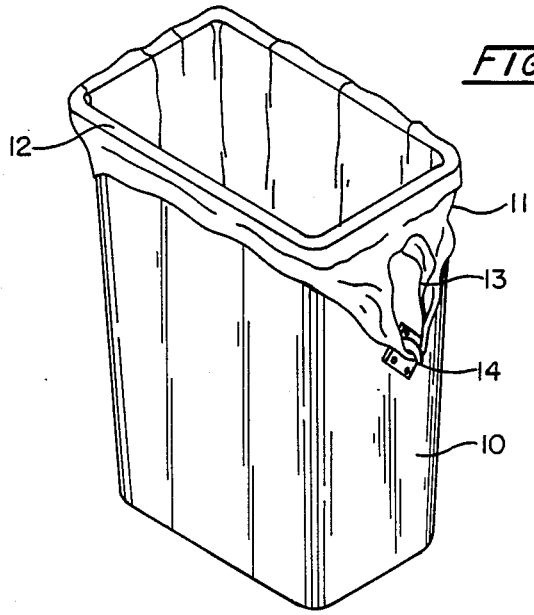
FIG. 1 is a perspective view of applicant's invention showing the trash container and the trash bag in said container and the external means to hold the trash bag in position on the container.

Referring now more particularly to FIG. 1, the trash container 10 is shown with the trash bag 11 completely covering the upper rim portion 12 of the trash container 10. The trash bag 11 is provided with handles 13—13 which are adapted to engage hooks 14—14 thereby to hold the trash bag 11 in place inside the container 10 and completely cover the upper rim portion 12 of the container 10.

Figure 2:
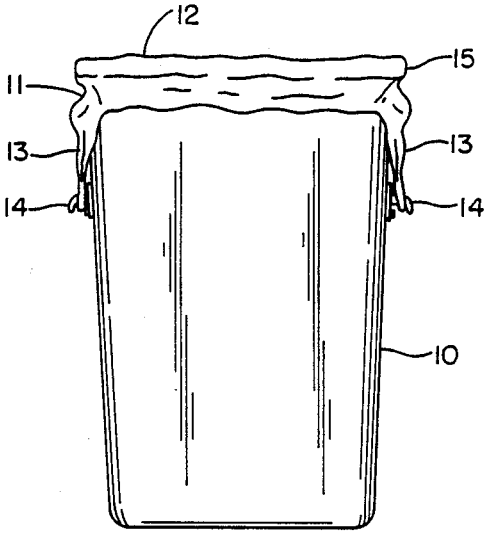
FIG. 2 is a front elevation view of the trash container shown in FIG. 1.
Figure 3:
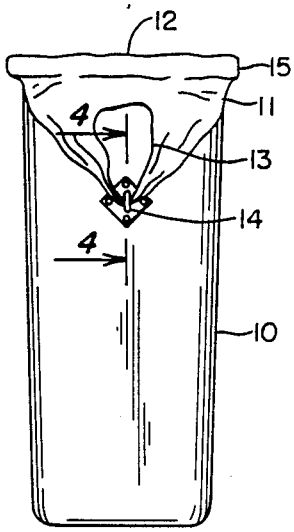
FIG. 3 is a side elevation view of the trash container shown in FIG. 1.

Referring now more particularly to FIGS. 2 and 3, it will be noted that the upper rim portion 12 of the trash container 10 is provided with a collar 15 of a sufficient thickness so that when the trash containers 10—10 are stacked one within the other a space will be provided between the bases of adjacent trash containers 10—10 approximately equal to the height of the collar 15.

Figure 4:
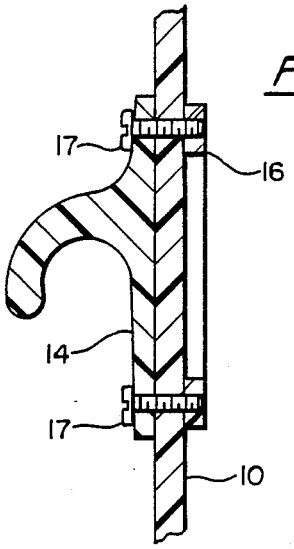
FIG. 4 is a section of the external means to hold the trash bag in place on the container shown in FIG. 3 on the section 4—4.

Referring now more particularly to FIG. 4, the hook member 14 is shown connected to a separate ring member 16, preferably made of a plastic material so that the screws 17—17 will be held firmly in place when threaded into member 16. If desired, the trash container 10 may be made with suitable weak spots at this location on the sides of the trash container 10 so that the weak spots can easily be knocked out by the purchaser so that the purchaser can install the hooks 14—14.

Figure 5:
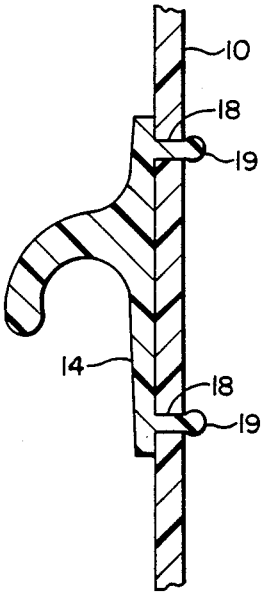
FIG. 5 shows a sectional view of a variation of such means.

Referring now more particularly to FIG. 5, a variation of hook 14 is shown which consists of upstanding legs 18—18 provided with enlarged portions 19—19 thereon so that when the legs 18—18 are forced through complementary holes in the wall of the trash container 10 the hook 14 will stay in place.

Figure 6:
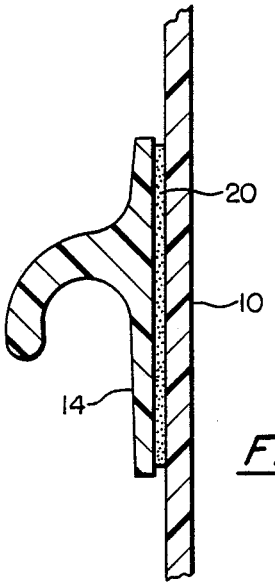
FIG. 6 shows a sectional view of a further variation of such means.

FIG. 6 shows a further variation of the hook 14 where the hook 14 is attached to the container by means of an adhesive 20.

In marketing this unit the trash containers 10—10 may be nested in the store with a package of a pair of hooks 14—14 and suitable fastening means if needed in a packet placed between each base member of the trash containers 10—10 and then the purchaser merely attaches the hooks 14—14, the method used depending upon the particular type of hook 14 which is furnished.

The trash bag 11 then may be simply placed inside the container 10 with the handles 13—13 placed on the hooks 14—14. When the trash bag 11 is full, the handles 13—13 are released and the entire trash bag 11 is readily lifted out of the trash container 10, with the trash container 10 being kept clean since it is covered with the trash bag 11.

Likewise, the hooks 14—14 may be sold in conjunction with a package of trash bags 11—11 so that existing trash containers 10—10 may be modified utilizing the hooks 14—14 furnished with a package of trash bags 11—11.

While this invention has been described in its preferred embodiment, it is to be appreciated that variations therefrom may be made without departing from the true scope and spirit of the invention.

What is claimed:

1. A trash container provided with a base member connected to side members of equal length forming an opening, means adjacent said opening so that when said trash containers are stacked, one within the other, there will be a space between adjacent base members, and two oppositely disposed sides of said trash container having a plurality of thinner portions capable of being readily removed to form holes to receive fastening means to hold hooks thereon. said hooks being provided with a plurality of upstanding members having enlarged ends which are received through said holes provided in the sides of said trash container thus retaining said hooks firmly against the sides of said trash container, said hooks being adapted to hold a flexible trash bag having two oppositely disposed handle means.

* * * * *